US005315066A

United States Patent [19]

Spiteri, Sr.

[11] Patent Number: 5,315,066

[45] Date of Patent: May 24, 1994

[54] SEALED WIRE CONNECTOR

[75] Inventor: Joseph Spiteri, Sr., Harborcreek, Pa.

[73] Assignee: Betts Industries, Inc., Warren, Pa.

[21] Appl. No.: 114,784

[22] Filed: Aug. 31, 1993

Related U.S. Application Data

[63] Continuation of Ser. No. 863,537, Apr. 6, 1992, which is a continuation of Ser. No. 700,087, May 6, 1991, abandoned, which is a continuation of Ser. No. 256,136, Oct. 7, 1988, abandoned, which is a continuation of Ser. No. 534,737, Sep. 22, 1983, abandoned, which is a continuation-in-part of Ser. No. 374,407, May 3, 1982, abandoned.

[51] Int. Cl.[5] ..... H01R 4/22

[52] U.S. Cl. ..... 174/87; 206/219; 403/268; 403/270

[58] Field of Search ..... 174/87; 206/219, 221, 206/222; 403/214, 396, 265, 268, 270

[56] References Cited

U.S. PATENT DOCUMENTS

| | | | |
|---|---|---|---|
| 2,199,532 | 5/1940 | Weeks | 171/326 |
| 2,772,323 | 11/1956 | Smith | 174/87 |
| 2,825,750 | 3/1958 | Stockwell | 174/87 |
| 2,862,616 | 12/1958 | Capozzi et al. | 206/147 |
| 3,061,455 | 10/1962 | Anthony | 117/37 |
| 3,083,260 | 3/1963 | Bird | 174/87 |
| 3,087,606 | 4/1963 | Bollmeier et al. | 206/47 |
| 3,385,922 | 5/1968 | Rice | 174/84 |
| 3,550,765 | 12/1970 | Anderson | 206/46 |
| 3,558,800 | 1/1971 | Wallis | 174/87 |
| 3,783,177 | 1/1974 | Kelso | 174/87 |
| 4,059,136 | 11/1977 | Wallace | 151/14.5 |
| 4,081,012 | 3/1978 | Wallace | 151/14.5 |
| 5,023,402 | 6/1991 | King, Jr. et al. | 174/87 |
| 5,113,037 | 5/1992 | King, Jr. et al. | 174/87 |
| 5,151,239 | 9/1992 | King, Jr. | 174/87 |

*Primary Examiner*—Morris H. Nimmo

*Attorney, Agent, or Firm*—Hodgson, Russ, Andrews, Woods & Goodyear

[57] ABSTRACT

A wire connector which includes a metal thread insert and at least two unmixed components within the connector cavity which are mixable as the insert is screwed onto bared wire ends to form a cement for bonding the connection of the bared wire ends to each other and to the insert. The components are separated by a barrier layer formed by a reaction at their interface. At least a portion of the insert is disposed inwardly of the cavity relative to the barrier layer. The barrier layer is pierceable by the bared wired ends during insertion thereof into the insert for screwing of said insert onto the bared wire ends.

6 Claims, 1 Drawing Sheet

SEALED WIRE CONNECTOR

This is a continuation of co-pending application Ser. No. 07/863,537, filed Apr. 6, 1992, which is a continuation of application Ser. No. 07/700,087, filed May 6, 1991 (now abandoned), which is a continuation of application Ser. No. 07/256,136, filed Oct. 7, 1988 (now abandoned), which is a continuation of application Ser. No. 06/534,737, filed Sep. 22, 1983 (now abandoned), which is a continuation-in-part of application Ser. No. 06/374,407, filed May 3, 1982 (now abandoned).

This is a continuation in part of application Ser. No. 06/374,407 filed May 3, 1982 incorporated by reference.

In wire connectors two types are known. In a screw type, a cap of insulating material with internal threads is screwed onto the connection between bared ends of wires or conductors. The screw threads make tight gripping contact with the bared ends of the wire. When used in wiring for trucks and other equipment subject to vibration and atmospheric conditions, this type of connector tends to loosen due to the combined effects of corrosion of the wires and vibration of the connection.

Examples of this type of connector are U.S. Pat. Nos. 2,772,323; 3,297,816; 3,448,223 and the connectors sold under the Trademark "WIRE NUT".

A second type of connector consists of a plastic cap holding a cement into which a connection already made up is inserted. Under the atmospheric and vibration conditions of the trucking industry, the cement cracks destroying the protection of the electrical connection.

Examples of this type of connector are U.S. Pat. Nos. 3,083,260 and 3,550,765.

While applicant's invention is of general application to both types of connectors, the screw-on connector is preferred and is illustrated in the accompanying drawings.

In the drawing

Figure 1:
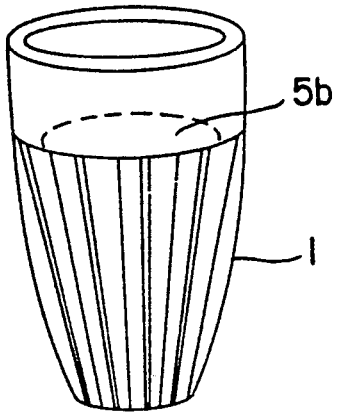
FIG. 1 is an elevation of a screw type wire connector.
Figure 2:
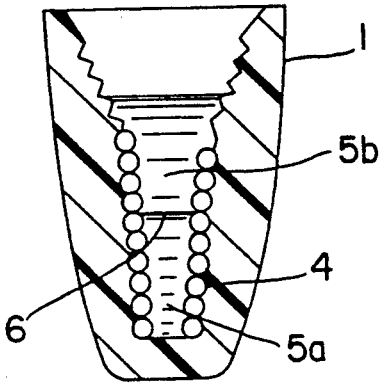
FIG. 2 is a diagrammatic section through the connector ready for making a connection.
Figure 3:
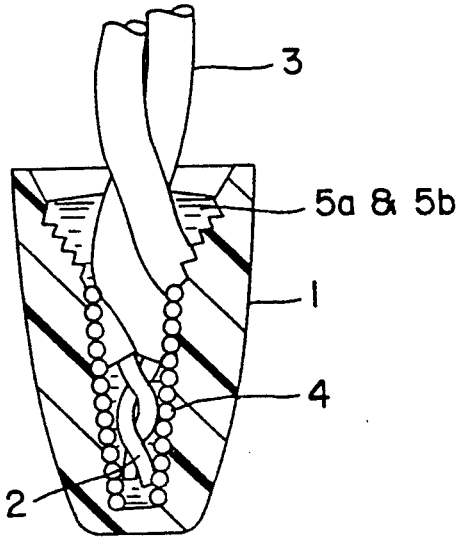
FIG. 3 is a view similar to FIG. 2 of the completed connection.

In the drawing 1 indicates a screw type wire connector of common construction used for making and protecting connections between two or more stripped or bared ends 2 of insulated wires 3. In the interior of the wire connector is a special thread, in this case a coil spring 4, which grips the bare wire ends 2 and twists them tightly together as the connector is screwed onto the wire ends. In earlier forms of the screw connector the threads were integral with the connector and had the same conductor gripping function as the connector was screwed onto the wire ends. The coil spring thread 4 is preferred for various reasons one of which is that the spring in addition to gripping the wire ends also forms a metallic connection between the wire ends. The connector, when tightened, makes a pressure electrical connection between the wire ends 2 and in this case, also between the wire ends 2 and the coil spring threads 4.

In the trucking industry where the connection is subject to shock and vibration and also to the corrosive effects of salt or other ice melting chemicals, the connector may work loose due to corrosion of the conductors or vibration thereby breaking the electrical connection. The breaking of the connection of the wires could cause arcing which would be dangerous in an explosive atmosphere To overcome these difficulties, the electrical connection between the wire ends 2 is made permanent under conditions of corrosion, shock and vibration by a two-component epoxy cement 5*a* and 5*b*. Any two-component epoxy may be used. These two components have a long shelf life when kept apart. The first component 5*a* is loaded into the empty connector 1 and fills the cavity approximately up to line 6. The second component 5*b* is then poured into the cavity on top of the first component completing the filling to the desired level. The coil spring 4 and the adjacent parts of the connector are coated with component 5*a* below line 6 and with component 5*b* above line 6. At the interface between the epoxy components 5*a* and 5*b* indicated by the line 6, there is a reaction between the two components which creates a thin membrane which blocks further reaction between the two components. The membrane made up of the reaction between components 5*a* and 5*b* is impervious to either component and thus after the membrane 6 is formed in place, no further reaction can take place because neither component can migrate through the membrane. So far as shipping and handling is concerned of the filled connector, it behaves as though it were filled with a single component 5*b*. If it requires protection from dirt and dust and other contamination, a removable seal or cover may be used. The connector does not need to be sealed. Exposure to the air does not cause any reaction with component 5*b* alone and component 5*a* is protected or kept from component 5*b* by the membrane 6. The shelf life of the connector loaded with components 5*a* and 5*b* is same as shelf life of the component 5*b* alone.

The following experiments illustrate the operation of the connector:

1. The toothpick was very carefully inserted from the top down through the component 5*b*, the membrane 6 and the component 5*a* and then very carefully withdrawn. An effort was made to effect this movement of the toothpick in and out of the filled connector with a minimum of disturbance. The result of this experiment was that the component 5*b* at the top of the connector was still substantially unreacted.

2. When the experiment was repeated with the toothpick inserted quickly and roughly without any attempt to minimize disturbance of the components 5*a* and 5*b*, there was a significant reaction between the components 5*a* and 5*b* although not a thoroughly complete reaction.

3. When the connector was screwed onto a connection between bared ends 2 of electrical conductors 3, the rotation of the connector relative to the wire ends produced a through and complete mixing of components 5*a* and 5*b*. When the connector was screwed on tight the coil spring 4 which formed the threads of the connector dug into the bared wire ends 2 and produced a direct metal-to-metal contact without any intervening cement. There was also a squeezing of the wire ends 2 into contact with each other to produce further metal-to-metal contact. This produced not only a good metal-to-metal electrical connection but it also produced a thorough reaction between the two components of the epoxy so that when the reaction was fully completed at the end of 72 hours it was impossible to remove the connector from the wire ends, Furthermore, there was a good seal between the epoxy and the wire ends preventing corrosion from ice melting chemicals and the like. The corrosion preventing seal prevents deterioration of the electrical connection by corrosion. The grip of the epoxy adhesive on the wires and screw threads of the connector prevents loosening of the connector by vibration.

In the manufacture, the two components of epoxy are sequentially loaded into the wire connector, one after the other in proper proportions. The connector is then ready for packing and shipment. The connectors are not large and the amount of epoxy required for each connector is small. Since mixing of the components is to be avoided, the component which is first loaded should not be spilled over parts of the connector which will subsequently be covered by the second component. Also, the second component should not be discharged as to agitate or mix with the first component. Both the connector and the loading equipment are industrially available.

I claim:

1. A wire connector comprising a housing composed of insulating material and having a cavity for receiving bared ends of insulated wires, thread means composed of metal and disposed within said cavity for screwing onto the bared wire ends and effecting a connection of the bared wire ends to each other and to said thread means, at least two unmixed components which are disposed within said cavity and which are mixable as said thread means is screwed onto the bared wire ends to form a cement for sealingly bonding the connection of bared wire ends to each other and to said thread means, and a chemical barrier layer located at the interface of the at least two unmixed components thus separating the at least two unmixed components and formed by a reaction at the interface between the at least two unmixed components, at least a portion of said thread disposed inwardly of said cavity means relative to said barrier layer, said barrier layer being pierceable by bared wire ends during insertion of the bared wire ends into said thread means for screwing of said thread means onto the bared wire ends.

2. A wire connector according to claim 1 wherein said thread means comprises a coil spring.

3. A wire connector according to claim 1 wherein the at least two unmixed components comprise an epoxy.

4. A wire connector according to claim 1 wherein the cement, when cured, is waterproof.

5. A wire connector according to claim 1 wherein the cement, when cured, protects the wires so as to resist corrosion.

6. A wire connector according to claim 1 wherein the cement, when cured, resists loosening of the connector due to vibration to thereby prevent breakage of the connection between the bared wire ends and the connector.

* * * * *